US007260953B2

(12) United States Patent
Kim et al.

(10) Patent No.: US 7,260,953 B2
(45) Date of Patent: Aug. 28, 2007

(54) AIR CONDITIONER

(75) Inventors: Dong Han Kim, Busan-si (KR); Jong Min Ha, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 280 days.

(21) Appl. No.: 10/714,667

(22) Filed: Nov. 18, 2003

(65) Prior Publication Data

US 2004/0144117 A1 Jul. 29, 2004

(30) Foreign Application Priority Data

Jan. 27, 2003 (KR) ..... 10-2003-0005363
Feb. 3, 2003 (KR) ..... 10-2003-0006624

(51) Int. Cl.
*F25D 23/12* (2006.01)
*F25D 19/00* (2006.01)

(52) U.S. Cl. ..... 62/262; 62/298; 62/259.1

(58) Field of Classification Search ..... 62/262, 62/259.1, 298, 302, 263
See application file for complete search history.

(56) References Cited

U.S. PATENT DOCUMENTS 2,717,508 A * 9/1955 Loveley et al. ..... 62/262
2,978,973 A * 4/1961 Sweedyk et al. ..... 62/262
5,461,880 A * 10/1995 Bolton et al. ..... 62/298
6,182,460 B1 * 2/2001 Hernandez et al. ..... 62/262
6,298,678 B1 * 10/2001 Kim ..... 62/262

* cited by examiner

*Primary Examiner*—Chen Wen Jiang
(74) *Attorney, Agent, or Firm*—McKenna Long & Aldridge LLP

(57) ABSTRACT

Disclosed is an air conditioner with an enhance efficiency. The air conditioner An air conditioner includes: an indoor part for inhaling indoor air to exchange heat with an indoor heat exchanger, and again discharging the heat-exchanged air into an indoor space; an outdoor part for inhaling an outdoor air to exchange heat with an outdoor heat exchanger, and again discharging the heat-exchanged air into an outdoor space; a base partitioned into the outdoor part and the indoor part and loaded on the partitioned outdoor part and indoor part; and a cabinet provided to cover both sides and a rear surface of the outdoor part, and having an insertion guide formed at a lower portion thereof.

7 Claims, 16 Drawing Sheets

AIR CONDITIONER

This application claims the benefit of the Korean Patent Application Nos. 2003-0005363 filed on Jan. 27, 2003 and 2003-0006624 filed on Feb. 3, 2003 which are hereby incorporated by reference.

BACKGROUND OF THE INVENTION

1. Field of the Invention

The present invention relates to an air conditioner, and more particularly, to an air conditioner provided with a curtain assembly for shielding a chink between the air conditioner and the window when the air conditioner is installed.

2. Discussion of the Related Art

Generally, air conditioner is installed at a window or the like of a building to air-condition an inner space of the building.

FIG. 1 is a perspective view illustrating appearance of a conventional air conditioner, and FIG. 2 is a perspective view illustrating an inner construction of a conventional air conditioner.

As shown in FIGS. 1 and 2, the conventional air conditioner includes a bottom base 1 of metal. Both sides and upper surface of the air conditioner are covered with a cabinet 3. The cabinet 3 has both lower ends coupled with both ends of the base 1, and an inner space for installing a variety of devices therein. An outdoor vent louver 4 formed at predetermined portions of the cabinet 3 functions as a passage through which outdoor air is inhaled into the inside of the outdoor part of the air conditioner.

The air conditioner includes a front panel 5 at a front surface thereof, and the front panel 5 includes a vent grill 7. The vent grill 7 functions as a passage through which indoor air is inhaled into the inside of the indoor part of the air conditioner. The front panel 5 has a discharge grill 9 at one side thereof. The heat-exchanged air in the air conditioner is discharged to an indoor space through the discharge grill 9. A filter is provided at a rear side of the vent grill 7 so as to purify the inhaled air.

An indoor heat exchanger 13 for exchanging heat with the air that has passed through the filter is installed at a rear side of the filter 11. The indoor heat exchanger 13 is installed at an air guide 15 mounted on the base 1. The air guide 15 guides indoor side airflow within the air conditioner. Further, the air guide 15 partitions the inside of the air conditioner into the indoor part and the outdoor part in case a separate barrier is not used. An orifice 16 guides the air that has passed through the indoor heat exchanger 13 to an indoor fan 19.

At a rear side of the air guide 15, i.e., at the outdoor part of the air conditioner, a motor 17 is provided. The motor 17 has a rotary shaft extended in bi-directions. One end of the rotary shaft penetrates the air guide 15 to extend to the indoor part, and the other end extends in an opposite direction. The indoor fan 19 is installed at the one end extending to the indoor part, and an outdoor fan 21 is installed at the other end of the rotary shaft. The indoor and outdoor fans 19 and 21 allow the airflow of the indoor part and the air of the outdoor part respectively.

To guide the airflow of the outdoor part, a shroud 23 is installed at the base 1. The shroud 23 has a space for installing the outdoor fan 21 therein to allow air to flow from one side to the other side of the space partitioned by the shroud 23. An outdoor heat exchanger 24 is installed at a rear space partitioned by the shroud 23. Accordingly, if a compressor 25 is driven, the outdoor heat exchanger 24 is heat-exchanged with the outdoor air introduced into the outdoor part through the vent louver 4. A separate discharge grill (not shown) is installed at a backside of the air conditioner to constitute the backside appearance of the air conditioner, and serves as a passage through which air that has passed through the outdoor heat exchanger 24 is discharged to the outdoor space.

In the meanwhile, a guide rail 27 is disposed on the cabinet 3. In installing the air conditioner at a window, a curtain assembly 30 for shielding a chink between the air conditioner and the window is coupled with the guide rail 27.

The curtain assembly 30 includes a curtain frame 32 having a section shaped in a '⊏' and a curtain 34 provided within the curtain frame 32 to shield the chink. An installation plate 33 is provided on the curtain frame 32 to fix the curtain assembly 30 to the window and at the same time to shield a chink between the curtain frame 32 and the window. One end of the curtain 34 in a horizontal direction is fixed to an inner portion of the curtain frame 32 and the other end is coupled to a side surface of the cabinet 3 by a screw. Accordingly, the curtain 34 has a screw coupling hole 35 at the other end thereof.

The guide rail 27 is disposed on the cabinet 3 and beneath the base 1 to guide movement of the curtain frame 32.

According to the conventional art, one end of the upper portion and one end of the lower portion in the curtain frame 32 are inserted into the guide rail 27 to be movable in a horizontal direction. Accordingly, the insertion length of the curtain frame 32 into the guide rail 27 is varied depending on the interval size between the window and the air conditioner.

However, the conventional air conditioner having the aforementioned construction has the following drawbacks.

The outer case is generally made of metallic material and is installed such that its lower portions of both sides are coupled with the base 1 on which parts of the air conditioner are equipped. Accordingly, to maintain and repair parts of the inside of the air conditioner, there is a drawback in that all the outer case 3 should be separated from the air conditioner. Also, in case the conventional air conditioner is large-sized, there is a drawback in that handling work such as carrying work is difficult.

Also, since the outdoor vent louver 4 is formed only at a part of the outer case 3, the amount of inhaled outdoor air is relatively small. To this end, there is caused a problem in that heat exchange in the indoor heat exchanger is not smooth.

In the meanwhile, the guide rail 27 is provided on the cabinet 3 and beneath the base. In other words, the guide rail 27 is exposed to the indoor space to injure the appearance of the air conditioner. Also, there is a problem in that air is leaked through a gap generated between the guide rail 27 and the window in the vertical direction.

In addition, since the guide rail 27 is fabricated after the cabinet 3 and the base 1 are fabricated, there is a problem in that the number of work processes is increased.

SUMMARY OF THE INVENTION

Accordingly, the present invention is directed to an air conditioner that substantially obviates one or more problems due to limitations and disadvantages of the related art.

An object of the present invention is to provide an air conditioner with an outer case that is easy to assemble and handle.

Another object of the present invention is to provide an air conditioner structured to increase the amount of exterior air inhaled into an outdoor part.

A further object of the present invention is to enhance the appearance of an air conditioner and to prevent air leakage from being generated.

Still another object of the present invention is to minimize the number of assembly processes in an air conditioner with a curtain assembly.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve the object and other advantages and in accordance with the purpose of the invention, as embodied and broadly described herein, there is provided an air conditioner comprising: an indoor part for inhaling indoor air to exchange heat with an indoor heat exchanger, and again discharging the heat-exchanged air into an indoor space; an outdoor part for inhaling an outdoor air to exchange heat with an outdoor heat exchanger, and again discharging the heat-exchanged air into an outdoor space; a base partitioned into the outdoor part and the indoor part and loaded on the portioned outdoor part and indoor part; and a cabinet provided to cover both sides and a rear surface of the outdoor part, and having an insertion guide formed at a lower portion thereof.

Here, the air conditioner further includes an outdoor cover provided at an upper portion of the cabinet so as to cover an upper portion of the outdoor part. Also, the cabinet includes a vent grill integrally formed at both sides thereof. Alternatively, the cabinet includes a discharge grill integrally formed at a rear surface thereof.

The insertion guide is formed along both sides and inner portion of a rear surface of the cabinet. Alternatively, he cabinet further includes a grip formed at both sides thereof.

To accomplish the above objects, in an aspect of the present invention, there is provided an air conditioner comprising: an indoor part for inhaling indoor air to exchange heat with an indoor heat exchanger, and again discharging the heat-exchanged air into an indoor space; an outdoor part for inhaling an outdoor air to exchange heat with an outdoor heat exchanger, and again discharging the heat-exchanged air into an outdoor space; a base partitioned into the outdoor part and the indoor part and loaded on the partitioned outdoor part and indoor part; a cabinet provided to cover both sides and a rear surface of the outdoor part, and having an insertion guide formed at a lower portion thereof; and an outdoor cover provided on an upper portion of the cabinet so as to cover the upper portion of the outdoor part.

Here, the outdoor cover is provided attachable on and detachable from the cabinet. The outdoor cover comprises a cover grill formed at a predetermined portion of the upper face thereof and through which outdoor air is inhaled. The outdoor cover further comprises an extension downwardly recessed with a predetermined width at a front side thereof. Alternatively, the air conditioner further includes a second plate forwardly extended with a predetermined width in front of the extension, the second plate being fixed to an upper end of a front frame.

Also, the base comprises a penetrated guide hole formed at a lower portion of the base to correspond to a position where the extension is formed.

To accomplish the above objects, in an aspect of the present invention, there is provided an air conditioner comprising: an indoor part for inhaling indoor air to exchange heat with an indoor heat exchanger, and again discharging the heat-exchanged air into an indoor space; an outdoor part for inhaling an outdoor air to exchange heat with an outdoor heat exchanger, and again discharging the heat-exchanged air into an outdoor space; a cabinet provided to cover both sides and a rear surface of the outdoor part, and having an extension downwardly recessed with a predetermined width at a front side thereof; a base having a guide hole formed at a lower portion thereof to correspond to a position where the extension is formed, the base being partitioned into the outdoor part and the indoor part and loaded on the partitioned outdoor part and indoor part; and a curtain assembly respectively provided at both sides of the extension and the guide hole to be slidable along the extension and the guide hole.

Here, the curtain assembly includes: a curtain provided for shielding a chink between a side surface of the air conditioner and a window; and a curtain frame supporting the curtain and inserted into the extension and the guide hole. The curtain frame includes: an upper horizontal bar inserted into the extension; a lower horizontal bar inserted into the guide hole; and a vertical bar connecting the upper horizontal bar and the lower horizontal bar with each other.

Here, a hanger plate is provided protruded inside the vertical bar and a first hanger strap formed at one side of the curtain is inserted into the hanger plate and is fixed.

To accomplish the above objects, in an aspect of the present invention, there is provided an air conditioner comprising: an indoor part for inhaling indoor air to exchange heat with an indoor heat exchanger, and again discharging the heat-exchanged air into an indoor space; an outdoor part for inhaling an outdoor air to exchange heat with an outdoor heat exchanger, and again discharging the heat-exchanged air into an outdoor space; a cabinet provided to cover both sides and a rear surface of the outdoor part, and having an insertion guide formed at a lower portion thereof; and a front panel covering the indoor part.

To accomplish the above objects, in an aspect of the present invention, there is provided an air conditioner comprising: an indoor part for inhaling indoor air to exchange heat with an indoor heat exchanger, and again discharging the heat-exchanged air into an indoor space; an outdoor part for inhaling an outdoor air to exchange heat with an outdoor heat exchanger, and again discharging the heat-exchanged air into an outdoor space; a base on which the outdoor part and the indoor part are installed; a cabinet provided to cover both sides and a rear surface of the outdoor part, and having an insertion guide formed at a lower portion thereof; and a barrier formed integrally with the base so as to partition an upper space of the base into the outdoor part and the indoor part.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiment of the present invention, examples of which are illustrated in the accompanying drawings. Wherever possible, the same reference numbers will be used throughout the drawings to refer to the same or like parts.

Hereinafter, air conditioners according to various embodiments of the present invention will be described in detail with reference to the accompanying FIGS. 3 to 12.

Figure 1:
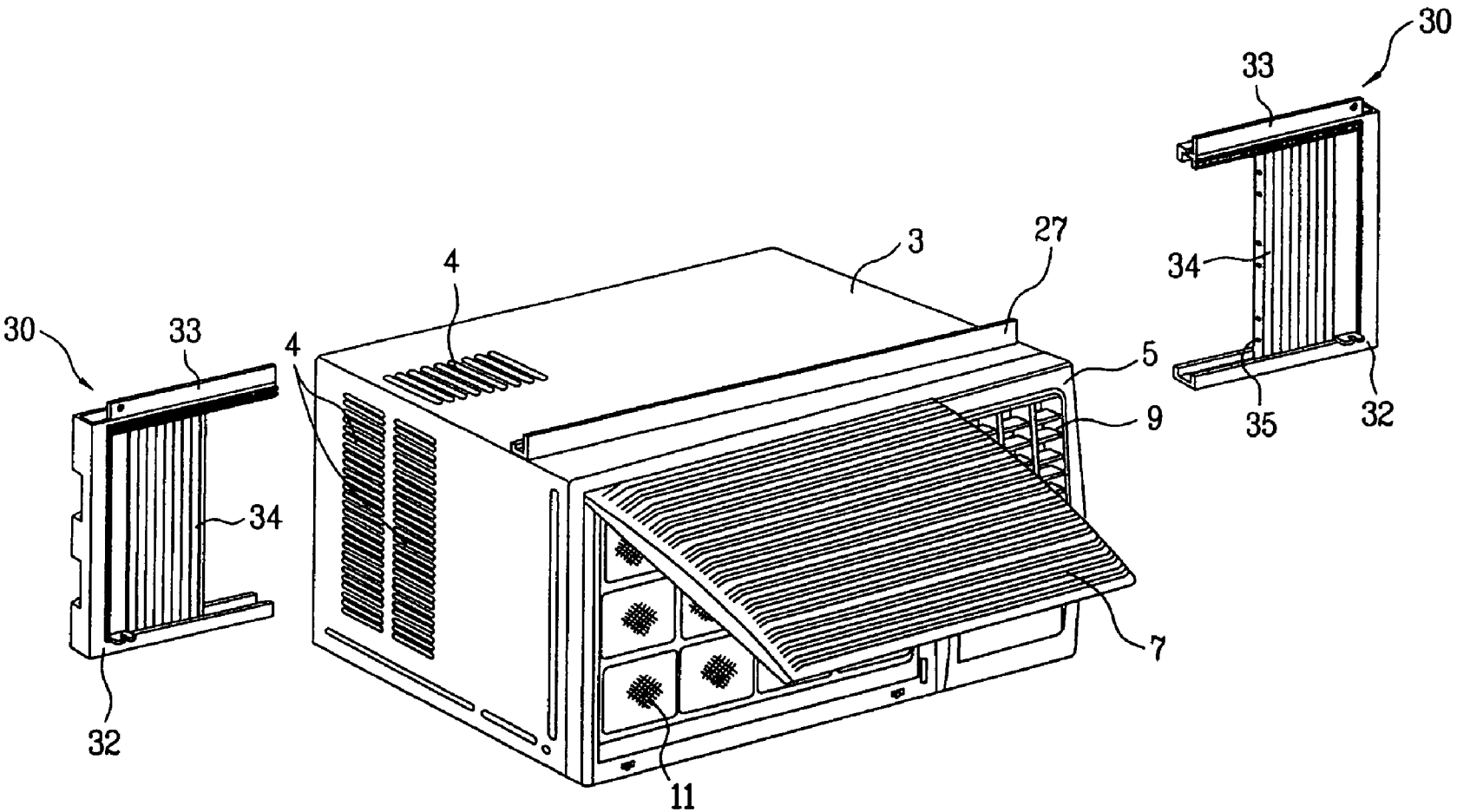
FIG.1 Prior Art
FIG. 1 is a perspective view illustrating appearance of a conventional air conditioner.
Figure 2:
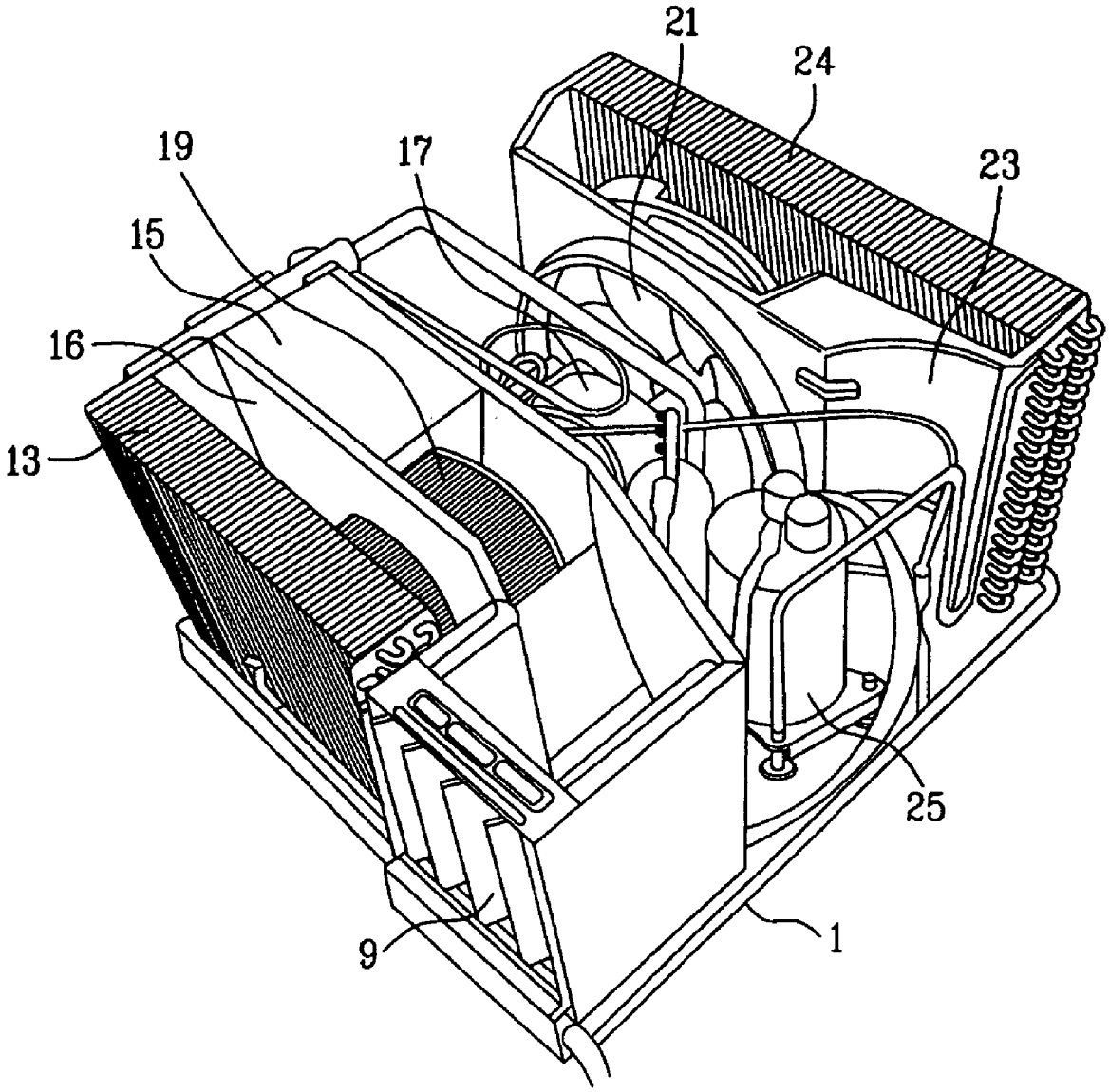
FIG. 2 Prior Art
FIG. 2 is a perspective view illustrating an inner construction of a conventional air conditioner.
Figure 3:
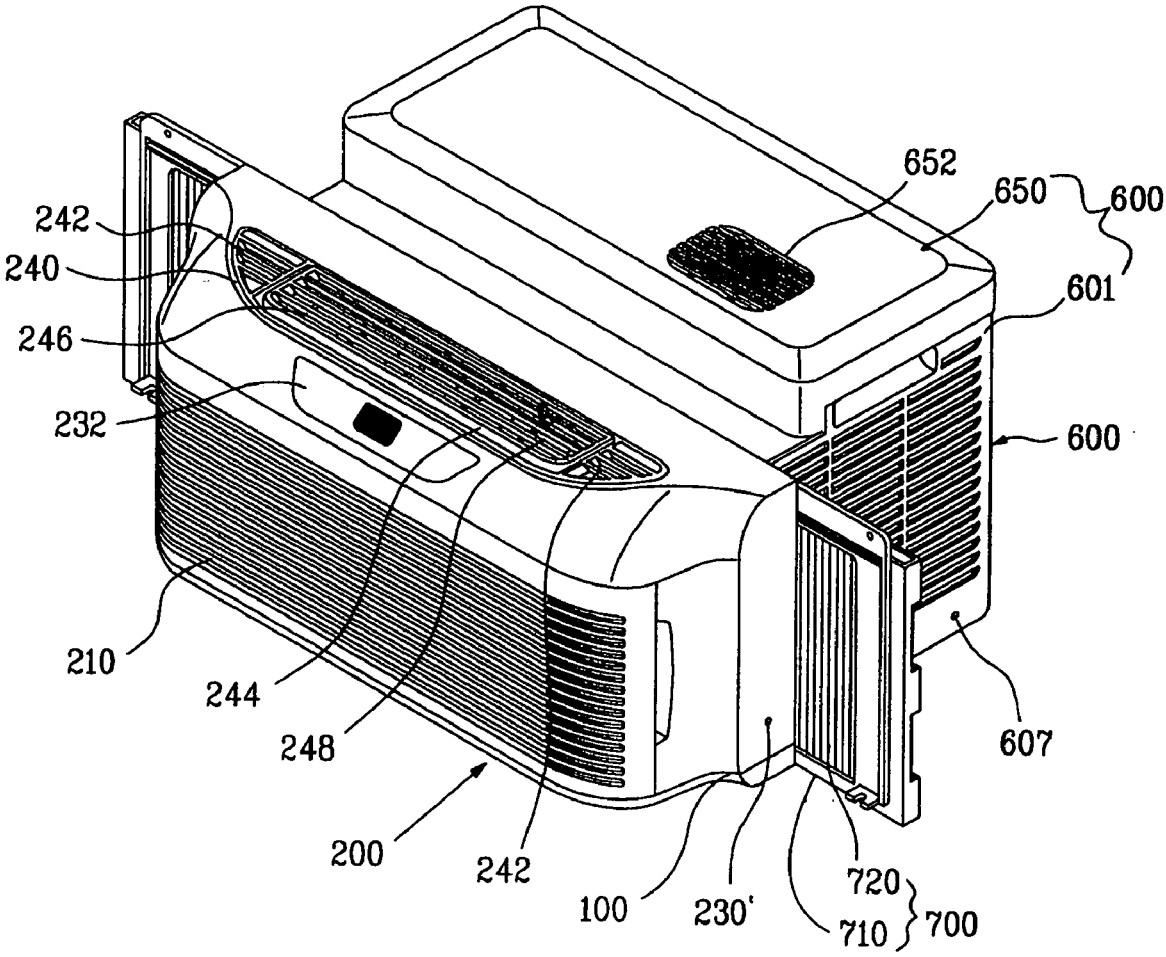
FIG. 3 is a perspective view illustrating an installation structure of a curtain assembly in an air conditioner according to the present invention.

As shown in FIG. 3, the air conditioner on appearance includes a base plate 100 constituting the bottom face, a front panel 200 provided at a front side of the base plate 100, a cabinet 601 provided at a rear side of the base plate 100, and an outdoor cover 650 provided on an upper portion of the cabinet 601. Further, a curtain assembly 700 is installed at both sides of left and right between the front panel 200 and the cabinet 601.

Figure 4:
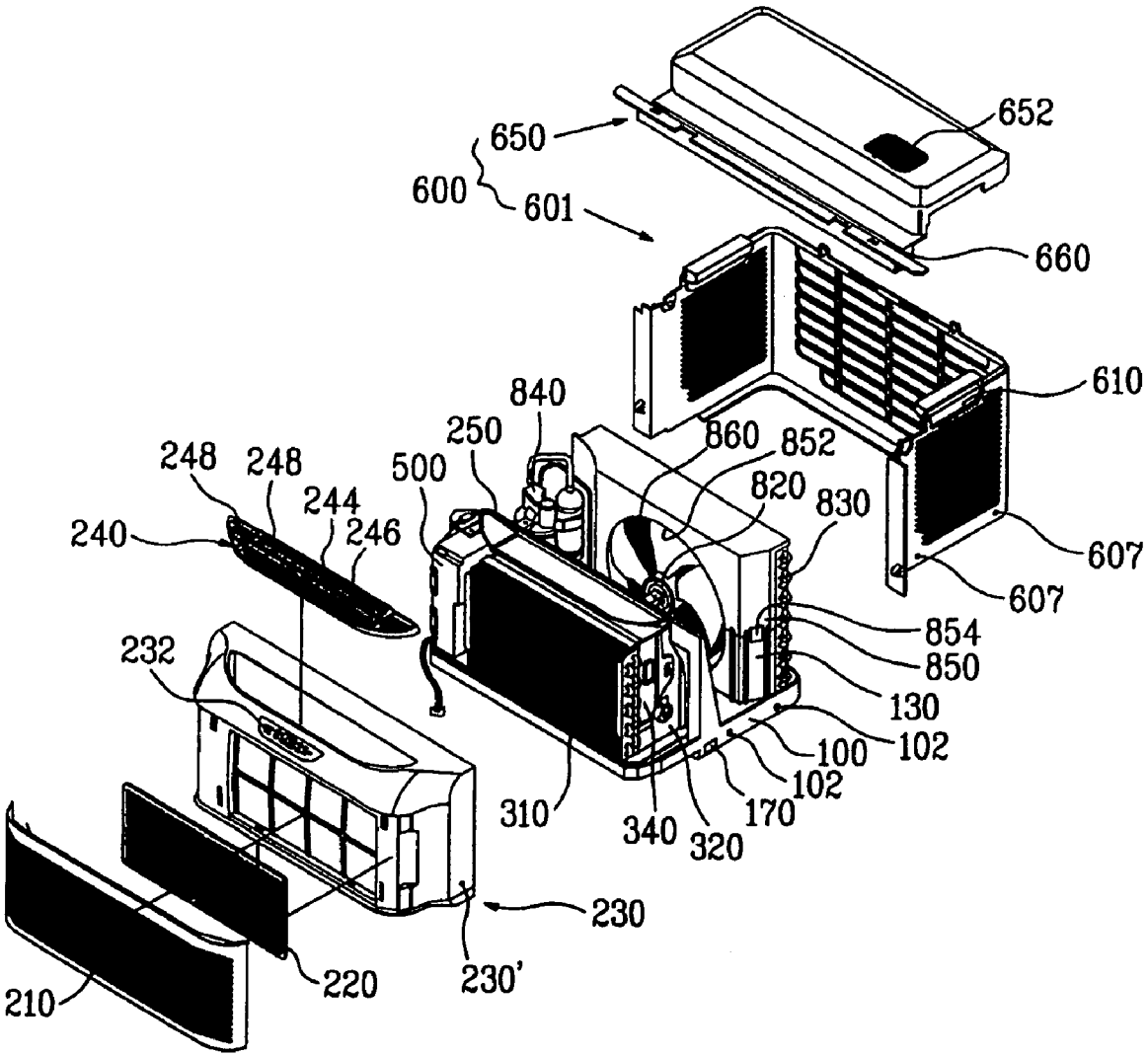
FIG. 4 is an exploded perspective view of an integral type air conditioner according to the present invention.
Figure 5:
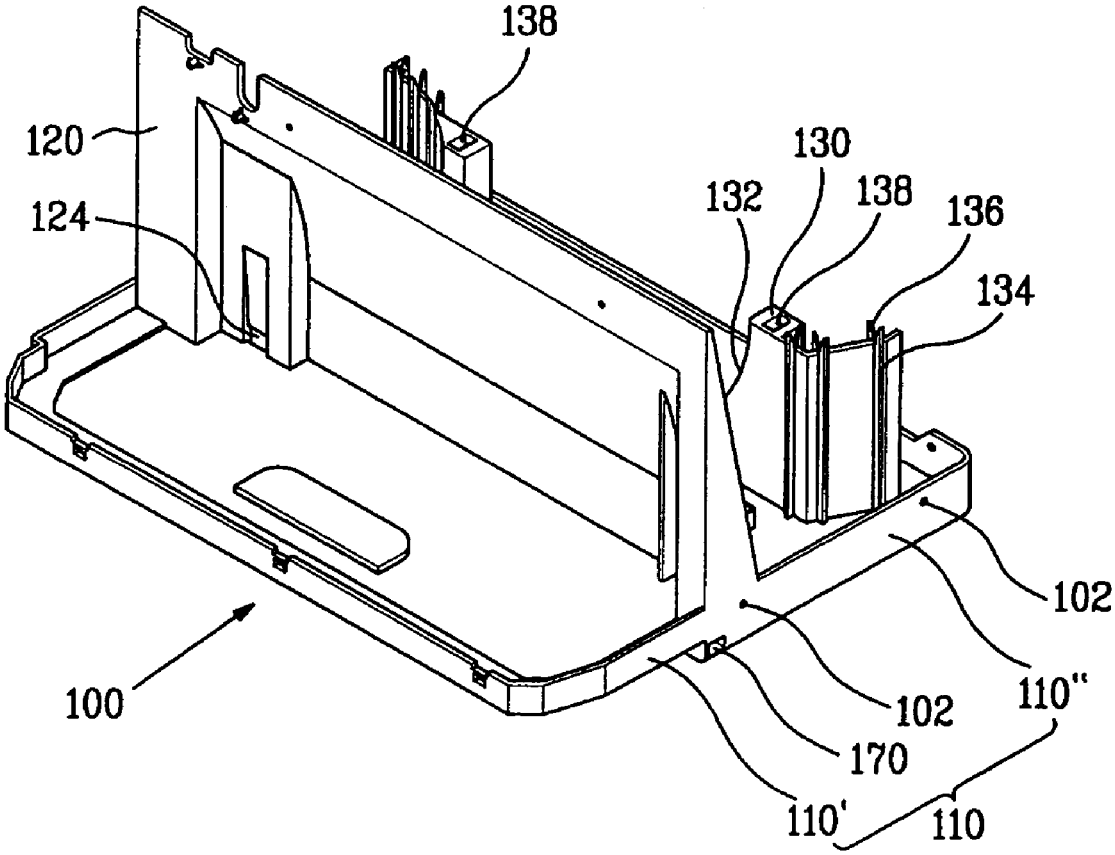
FIG. 5 is a perspective view illustrating a base of an air conditioner according to the present invention, centered on the indoor part.
Figure 6:
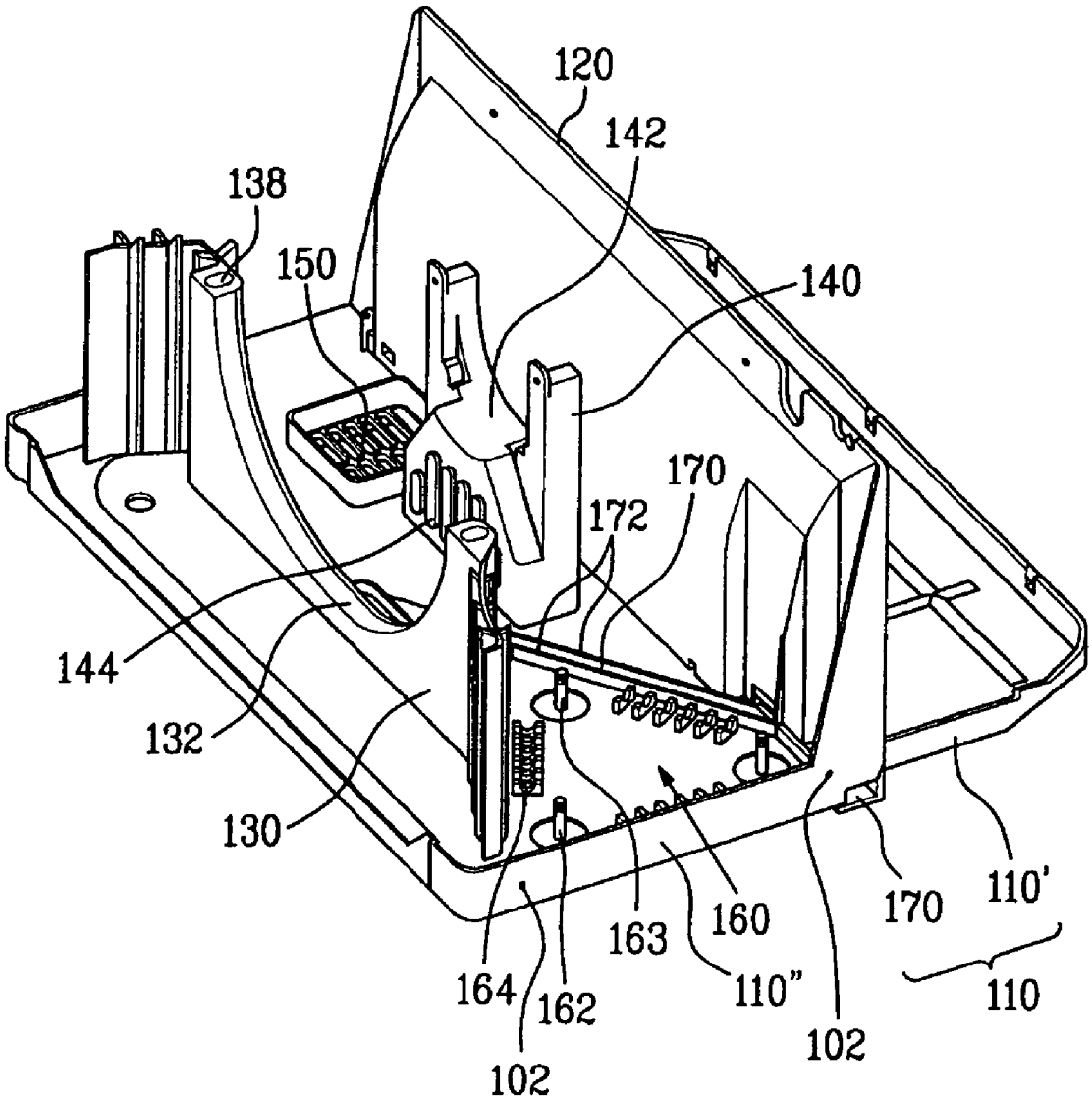
FIG. 6 is a perspective view illustrating a base of an air conditioner according to the present invention, centered on the outdoor part.

FIG. 4 is an exploded perspective view of an integral type air conditioner according to the present invention, FIG. 5 is a perspective view illustrating a base of an air conditioner according to the present invention, centered on the indoor part, and FIG. 6 is a perspective view illustrating a base of an air conditioner according to the present invention, centered on the outdoor part.

As shown in FIG. 4, at the lower side of the air conditioner, the base plate 100, which is injection-molded from a material such as resin or the like, is provided. Here, the base plate 100 represents a support body comprised of a base 110, a barrier 120 and a lower shroud 130 integrally formed. The base 110 constitutes a bottom of the air conditioner and the barrier 120 is formed at an upper portion of the base 110 to partition the inner space into an indoor part and an outdoor part. At both sides of the base 110, a coupling hole 102 for coupling the cabinet 601 is formed.

The base 110 is divided into an indoor base 110' and an outdoor base 110", the indoor base 110' being located at the front side from the barrier 120 and the outdoor base 110" being located at the rear side from the barrier 120. The indoor base 110' forms a bottom of the indoor part positioned at the indoor side when the air conditioner is installed at the window of a building. On the contrary, the outdoor base 110" forms a bottom of the outdoor side positioned at the outdoor side.

An indoor heat exchanger 310 is provided in the indoor part to exchange heat with indoor air blown by an indoor fan. Condensed water generated in the indoor heat exchanger 310 is guided to the outdoor part through a condensed water hole 124.

The lower shroud 130 is formed protruded upward on the outdoor base 110", and a semicircle part 132 is formed thereon. The lower shroud 130 is coupled with the upper shroud 850 to form a circular hole 860 communicating with the outdoor heat exchanger 830. A blower fan 820 is installed at the hole 860.

As shown in FIG. 5, at both sides of the lower shroud 130, there is provided a reinforcing rib 134 for reinforcing the strength of the lower shroud 130 in a shape that is extended upward and downward. At an upper portion of the reinforcing rib 134, a loading part 136 shaped in an inverse triangle to guide the upper shroud 850 to be installed safely. At top portions of both sides of the semicircle part 132 of the lower shroud 130, a hole is formed respectively. An insertion protrusion of the upper shroud 850 is inserted into and fixed to the hole 138.

As shown in FIG. 6, a motor installation part 140 is formed between the lower shroud 130 and the barrier 120 to be protruded upward from the outdoor base 110". An outdoor motor is installed at a groove 142 formed at an upper portion of the motor installation part 140 in a semicircle shape. The motor installation part 140 is preferably installed in a structure integrated with the outdoor base 110".

At one side of the motor installation part 140, a lower grill 150 penetrating the outdoor base 110" is formed. At a circumference of the lower grill 150, an extension 152 is formed to guide air inhaled from a lower portion of the outdoor base 110".

Also, a compressor (840 of FIG. 5) is stably fixed to a compressor installation part 140, which is provided at the other side of the motor installation part 140. Three fixing protrusions 162 shaped in a triangle are provided at the compressor installation part 160. Between the fixing ribs 164, a support rib 164 is formed. The support rib 164 has a loading groove and is coupled to a lower surface of an installation plate. The fixing protrusions are inserted into and coupled to holes formed at the installation plate (not shown) provided below the compressor 840.

Figure 7:
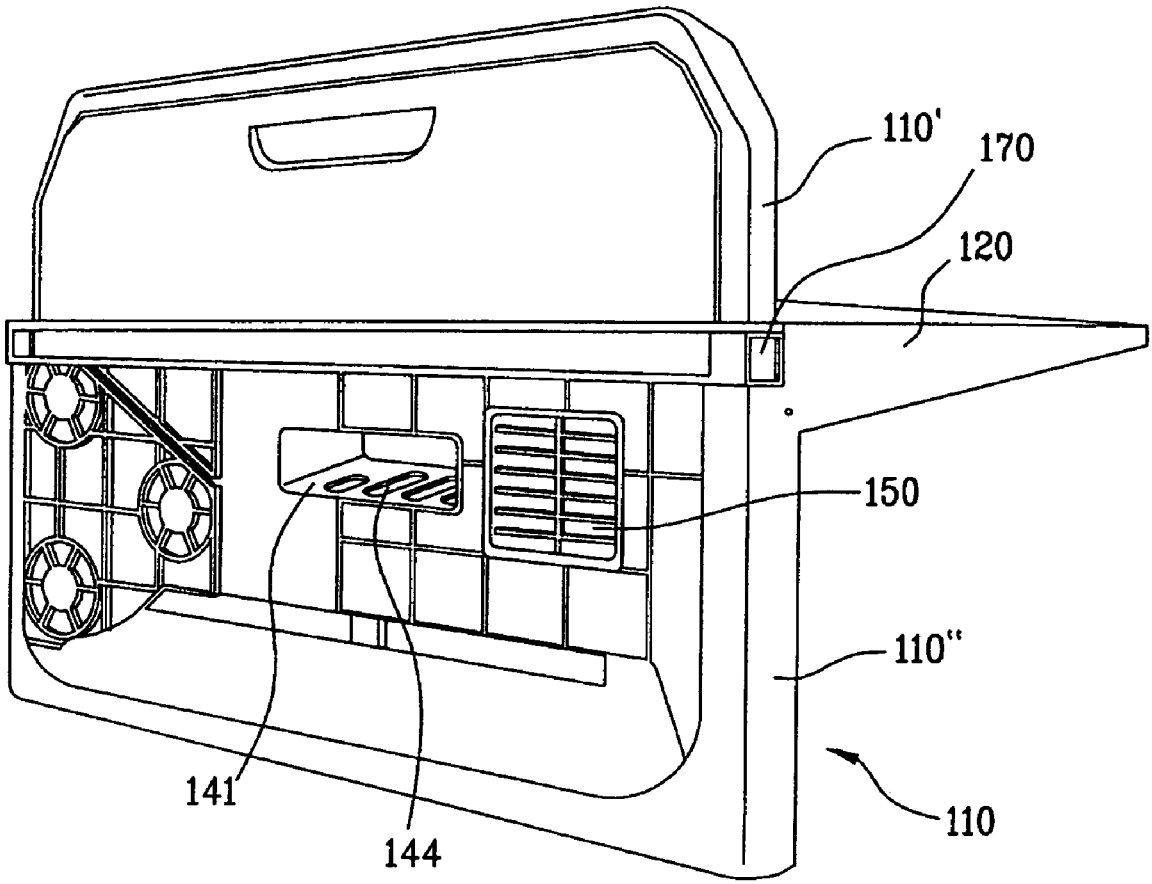
FIG. 7 is a perspective view illustrating the lower portion of an air conditioner according to the present invention.

As shown in FIG. 7, inside the motor installation part 140, a predetermined space 141 is formed. The space 141 communicates with an exterior through a lower portion of the outdoor base 110". At a face directed toward the lower shroud 130 of the motor installation part 140, a plurality of slits are formed and communicate with an exterior through the space 141. Accordingly, outdoor air is inhaled to the inside of the outdoor part from the lower portion of the outdoor base 110" through the slits 144.

In the meanwhile, a guide hole 170 is formed at both ends of the base 110 corresponding to a position where the barrier 120 is formed. The guide hole 170 is formed integrated with the base 110, and the curtain assembly 700 is inserted in the guide hole 170. The guide hole 170 is provided below the barrier 120 to correspond to the barrier 120 being formed across the base 110, and penetrates both ends of the base 110. In other words, the guide holes at both ends of the base 170 are connected with each other.

The indoor part of the base 110 is covered by the front panel 200. At a front side of the front panel 200, there is provided a vent grill 210 through which indoor air is introduced. At a rear side of the vent grill 210, an air filter 220 is provided. A discharge frame 240 is provided at an upper portion of the front frame 230.

As shown in FIG. 3, a pair of integral type grill parts 242 are formed at both ends of the discharge frame 240, and a discharge grill 244 is detachably provided between the grill parts 242. A plurality of horizontal ribs 248 for guiding flow of discharge air and preventing finger or the like from being inserted are formed in the discharge grill 244 in a horizontal direction. Below the horizontal ribs 248, a vertical rib 246 for controlling flow direction of discharge air is provided. Also, a discharge guide 250 for guiding flow of air discharged from the indoor part of the air conditioner is coupled to a lower surface of the discharge frame 240.

The indoor heat exchanger 310 provided inside the front panel 200 exchanges heat with air inhaled through the vent grill 210.

Figure 8:
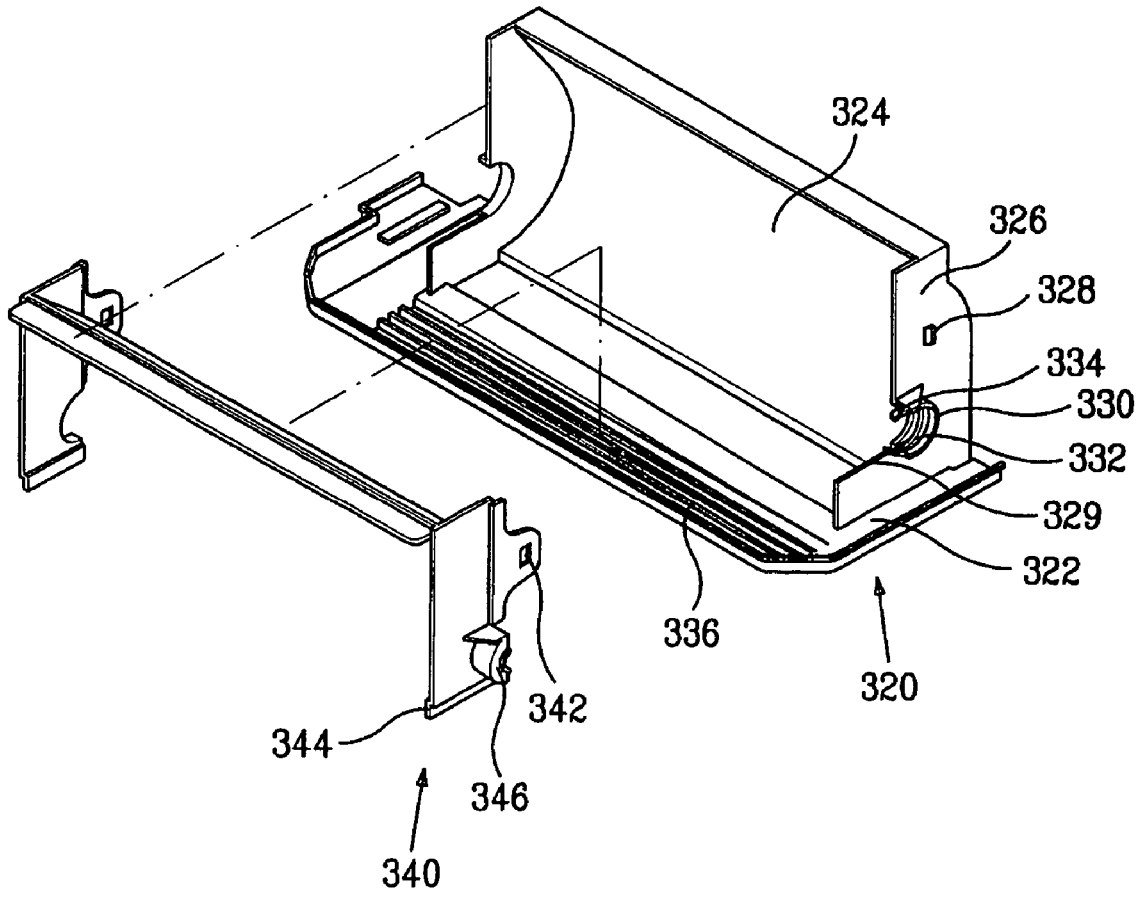
FIG. 8 is a perspective view illustrating an indoor fan and an indoor motor installation part of an air conditioner according to the present invention.

As shown in FIG. 8, the indoor heat exchanger 310 is installed in front of a lower air guide 320. The lower air guide 320 includes a bottom plate 322 constituting the bottom face, a rear wall part 324 provided at a rear end of the bottom plate 322 in a round shape, and a sidewall part 326 provided forwardly extending from both sides of the rear wall part 324.

At the sidewall part 326, there is formed a hanging protrusion 328 to which a hanging ring 342 of an upper air guide 340 is being coupled. A semicircle protrusion 332 is formed at a lower fan support part 330 formed at the right sidewall part 326 in a semicircle shape, along the center of the semicircle.

Figure 9:
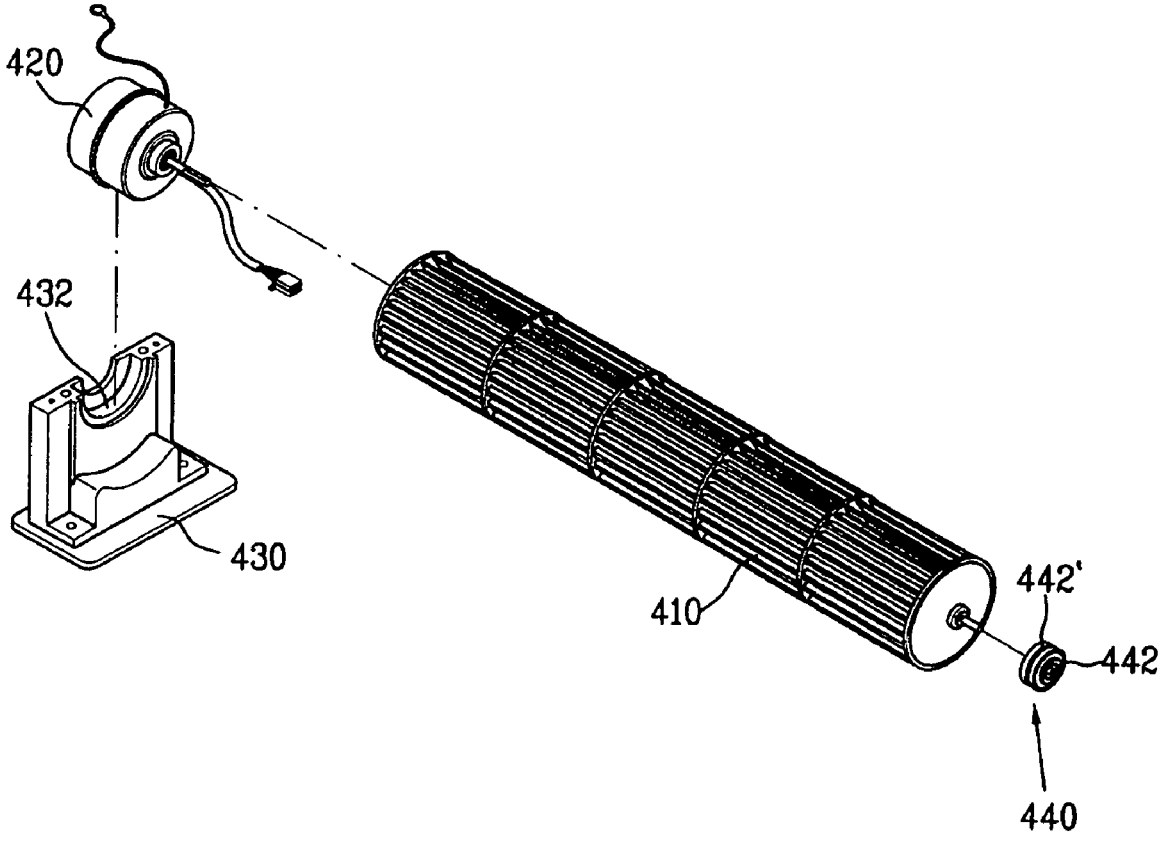
FIG. 9 is a perspective view illustrating the structure of an indoor fan and an indoor motor according to the present invention.

A bearing assembly 440, which is installed at one sided shaft of the indoor fan shown in FIG. 9, is inserted in the semicircle protrusion 332. A fixing rib 334 for preventing the bearing assembly 440 from being released is formed forwardly protruded.

The rear wall part 324 is provided in a backward recessed round shape so as to guide airflow in the indoor part. Preferably, the barrier 120 provided at a rear side of the rear wall part 324 is also provided in a round shape corresponding to the shape of the rear wall part 324.

A condensed water channel 336 is provided to exhaust condensed water generated in the indoor heat exchanger 310 provided thereon.

The upper air guide 340 is coupled on and with the lower air guide 320. The discharge guide 250 is installed in a penetration structure at an upper portion of the upper air guide 340. The hanging protrusion 328 formed at the sidewall part 326 of the lower air guide 320 is coupled with the hanging ring 342 formed at a side surface of the upper air guide 340 and thereby the upper air guide 340 is coupled with the lower air guide 340.

A stepped face 344 formed at a lower side of the upper air guide 340 is easily coupled with a front upper face 329 of the sidewall part 326 of the lower air guide 320 to effectively shield air leakage. An upper fan support part 346 is formed at a side surface and is coupled with the lower fan support part 330 integrally formed with the lower air guide 320.

As shown in FIG. 9, as the indoor fan 410, a cross flow fan for blowing air inhaled thereinto in a centrifugal direction is used. The blown air is guided along the upper air guide 320, the lower air guide 320 and the discharge guide 250 and is then discharged through the discharge grill 244.

At the left side of the indoor fan 410, there is provided an indoor motor 420 for rotating the indoor fan 410. The indoor motor 420 is installed at an indoor motor installation part 430 coupled to an upper surface of the base 100. In other words, the indoor motor 420 is installed at a downwardly recessed semicircle groove of an upper center portion of the indoor motor installation part 430.

The bearing assembly 440 is installed at the right central shaft of the indoor fan 410. The bearing assembly 440 is comprised of a bearing inserted therein, and a bearing cover 442 of rubber. The bearing cover 442 is shaped in a pulley and has an insertion groove 442' formed at its center along the cylindrical surface. The insertion groove 442' is coupled with the semicircle protrusion 332 of the lower fan support part 330 and thereby the bearing assembly 440 is fixed.

At the left side of the indoor motor installation part 430, there is installed a control box 500 in which electric devices are equipped.

Figure 10:
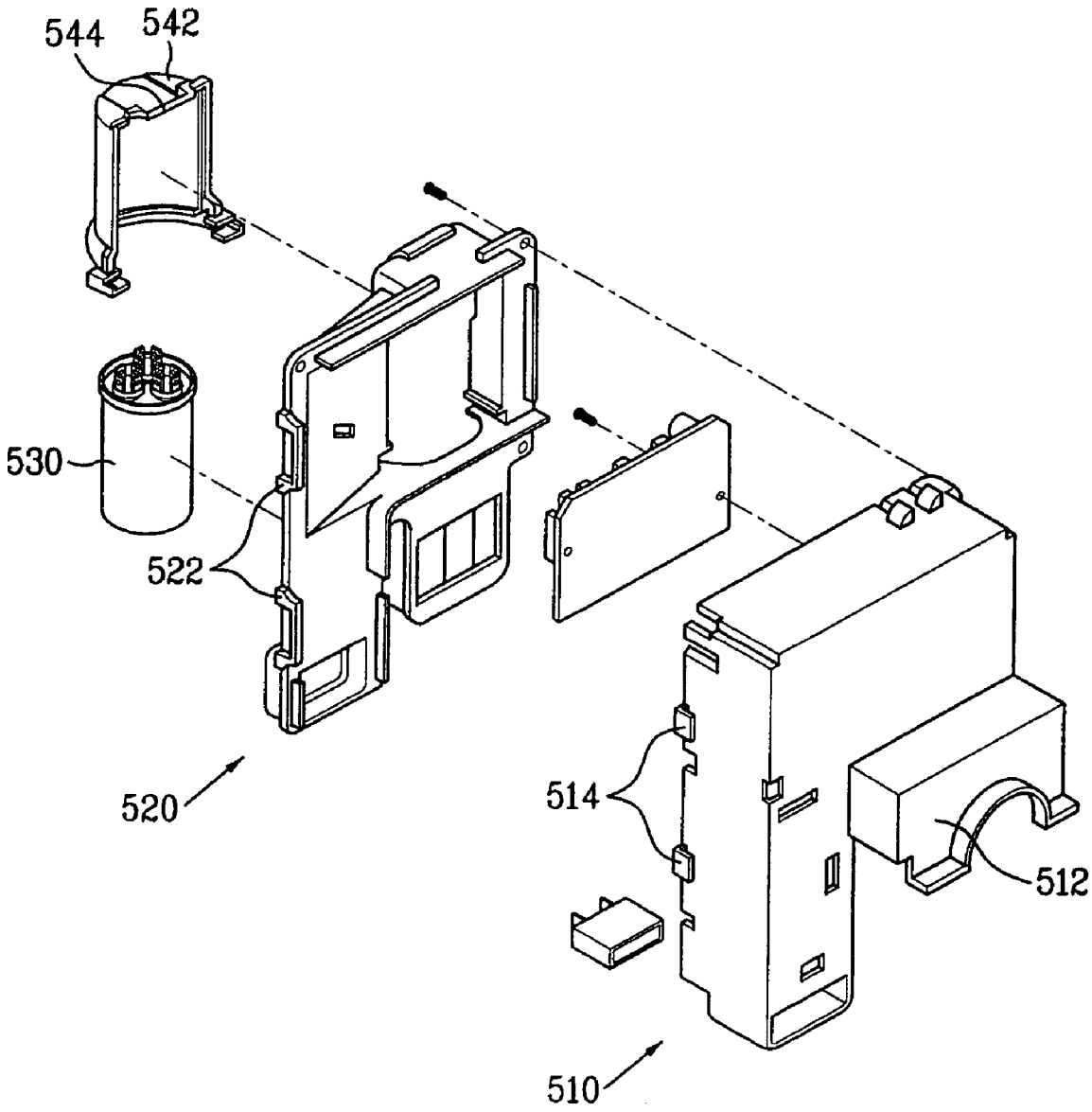
FIG. 10 is a perspective view illustrating a control box according to the present invention.

As shown in FIG. 10, the control box 500 is configured to include a body part 510 and a cover part 520. The body part 510 is shaped in a box of which left side is opened, and a motor cover part 512 covering the top portion of the indoor motor 420 is formed integrally with the body part 510 at the right side of the motor part 510. A coupling hook 514 is formed at a front left side of the body part 510 with a predetermined gap in a vertical direction.

The opened portion of the body part 510 is covered by the cover part 520. At a front portion of the cover part 520, the coupling hooks 514 are hooked on coupling grooves 522 formed spaced apart by a predetermined distance from each other in a vertical direction. Accordingly, the cover part 520 can be opened or closed by rotatably moving with the coupling hooks 514 as the rotational shaft.

On an outer surface of the cover part 520, a capacitor loading part for installing a capacitor 530 is further provided. The capacitor loading part is formed at an outer lower portion of the cover part 520. A capacitor cover 542 is provided to shield connection wires provided on the capacitor 530 loaded on the capacitor loading part. An upper portion of the capacitor cover 542 is hooked on and coupled with an upper portion of the cover part 520, and a lower portion of the capacitor cover 542 is inserted into and fixed to a portion of the capacitor loading part.

In the meanwhile, an outer case 600 forming the outer appearance of the outdoor part of the air conditioner is configured to include a cabinet 601 and an outdoor cover 650. The cabinet 601 is shaped in '⊏' when viewed from top, and constitutes the rear portion and the side portions.

At both sides of the cabinet 601, there is formed a vent louver 602 that is a passage through which air is inhaled. The vent louver 602 is formed throughout most of the side area of the cabinet 601. A discharge grill part 603 is formed at a rear side of the cabinet 601. The air that has passed the outdoor heat exchanger 830 through the discharge grill part 603 is discharged to an exterior.

At an upper portion of the outdoor cover 650, a predetermined sized cover grill part 652 is formed. The cover grill part of the outdoor cover 650 also serves as a passage through which outdoor air is inhaled inside the air conditioner.

Figure 11:
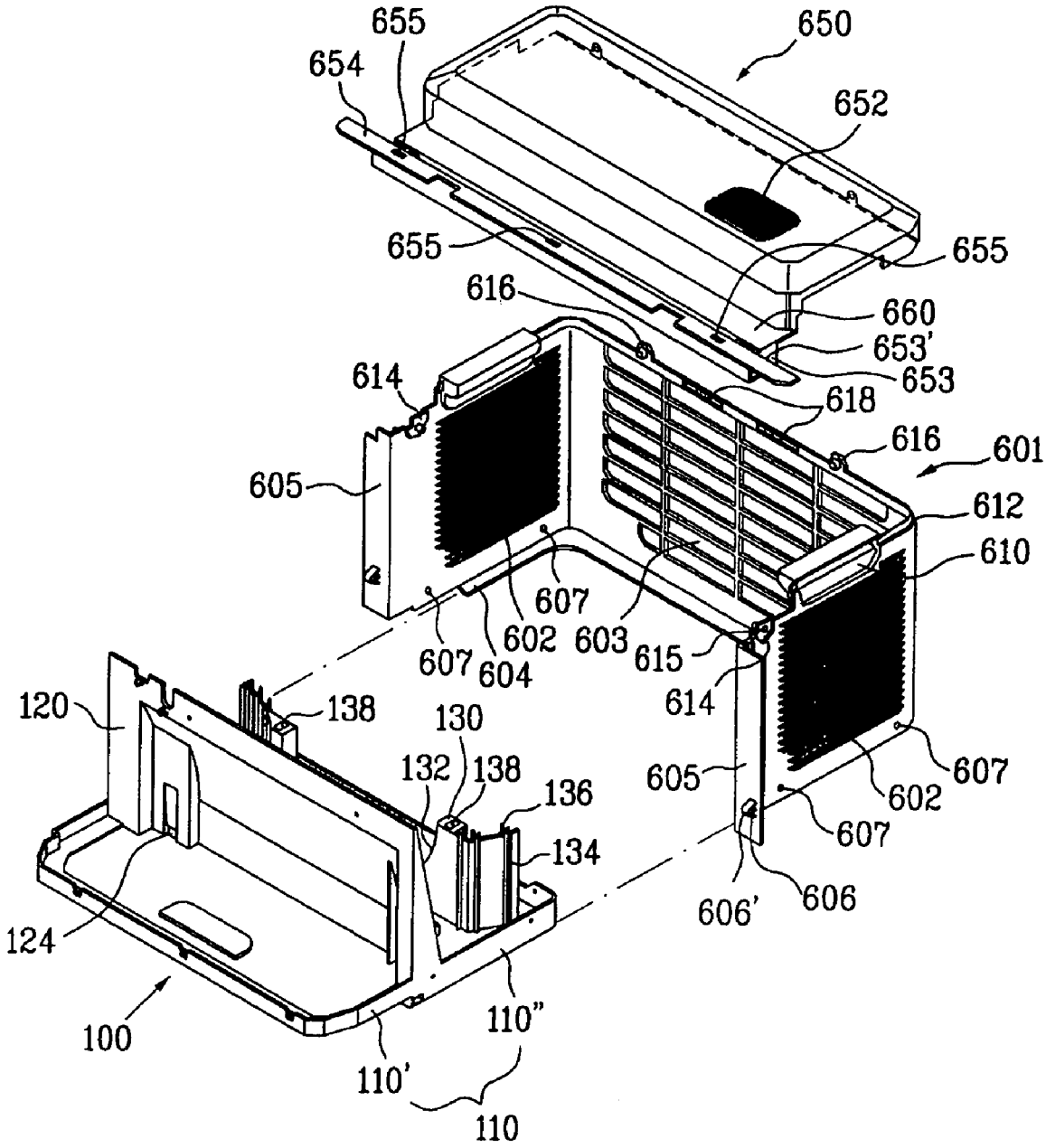
FIG. 11 is a perspective view illustrating a cabinet covering the outdoor part of an air conditioner according to the present invention, and an outdoor part cover.

As shown in FIG. 11, an insertion guide 604 is formed along an inner lower portion of the cabinet 601. The insertion guide 604 guides the base 110 to be inserted into the cabinet 601. Also, the base 110 is loaded on the upper surface of the insertion guide 604.

A first plate 605 is respectively provided at front sides of the cabinet 601. The first plate 605 is shaped in a plate formed long in a vertical direction with a predetermined width, and is coupled with the front panel 200. The first plate has a coupling protrusion 606 with a hole 606'. The hole 606' corresponds to a hole 230' formed in the front panel 200.

A hole 607 is respectively formed at corresponding locations to the coupling hole 102 formed in the base at both lower sides of the cabinet 601. Screws are coupled to the holes 607, 102 and thereby the cabinet 601 is fixed to the base 110.

Figure 12:
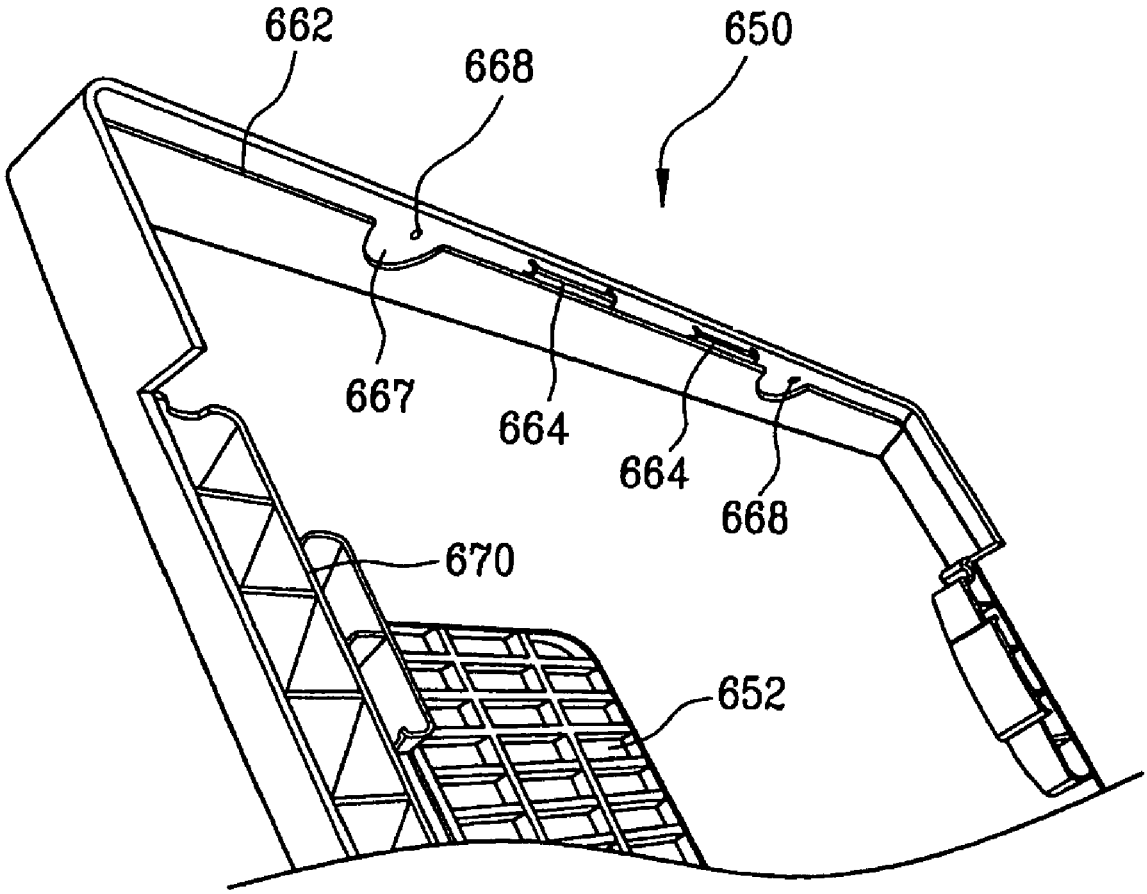
FIG. 12 is a partial detailed view of an outdoor part cover according to the present invention.

Referring to FIGS. 11 and 12, a first step part 612 is formed along an upper end of the cabinet 601. The first step part 612 is coupled to contact a second step part 662 formed at an inner lower edge of the outdoor cover 650. In other words, they are coupled such that the stepped surfaces between the step parts 612 and 662 are in contact with each other, thereby more effectively preventing leakage between the cabinet 601 and the outdoor cover 650.

At a rear upper end of the cabinet 601, a first coupling piece 616 for coupling with the outdoor cover 650 is formed. The first coupling piece 616 also has a hole inwardly extended so as to couple and accommodate a long screw.

Again referring to FIGS. 11 and 12, between the first coupling pieces 616 positioned at the rear upper end of the cabinet 601, an insertion slot 618 is formed long. An installation protrusion 664 formed in the outdoor cover 650 is inserted in the insertion slot 618. A recess 667 is formed at a rear inner portion of the outdoor cover 650 corresponding to the first coupling piece 616 of the cabinet 601. The first coupling piece 616 is loaded on the recess 667. The recess 667 has a hole 668, and a screw penetrating the hole formed in the first coupling piece 616 is screwed in the hole 668 of the recess 667.

Holes 615 for coupling with the outdoor cover 650 are formed at loading recesses 614, which are formed at front upper portions of both sides of the cabinet 601. The holes 615 are formed inwardly extended so as to couple and accommodate a relatively long screw.

A cover grill part 652 that is an inhale passage of outdoor air is formed at the outdoor cover 650 installed on the upper portion of the cabinet 601. Second coupling pieces 653 are formed at front upper ends of both sides of the outdoor cover 650 and are loaded on the loading recess 614. At this time, a hole 653' formed in the second coupling piece 653 communicates with the hole 615 formed in the loading recess 614 for the screw coupling.

Figure 13:
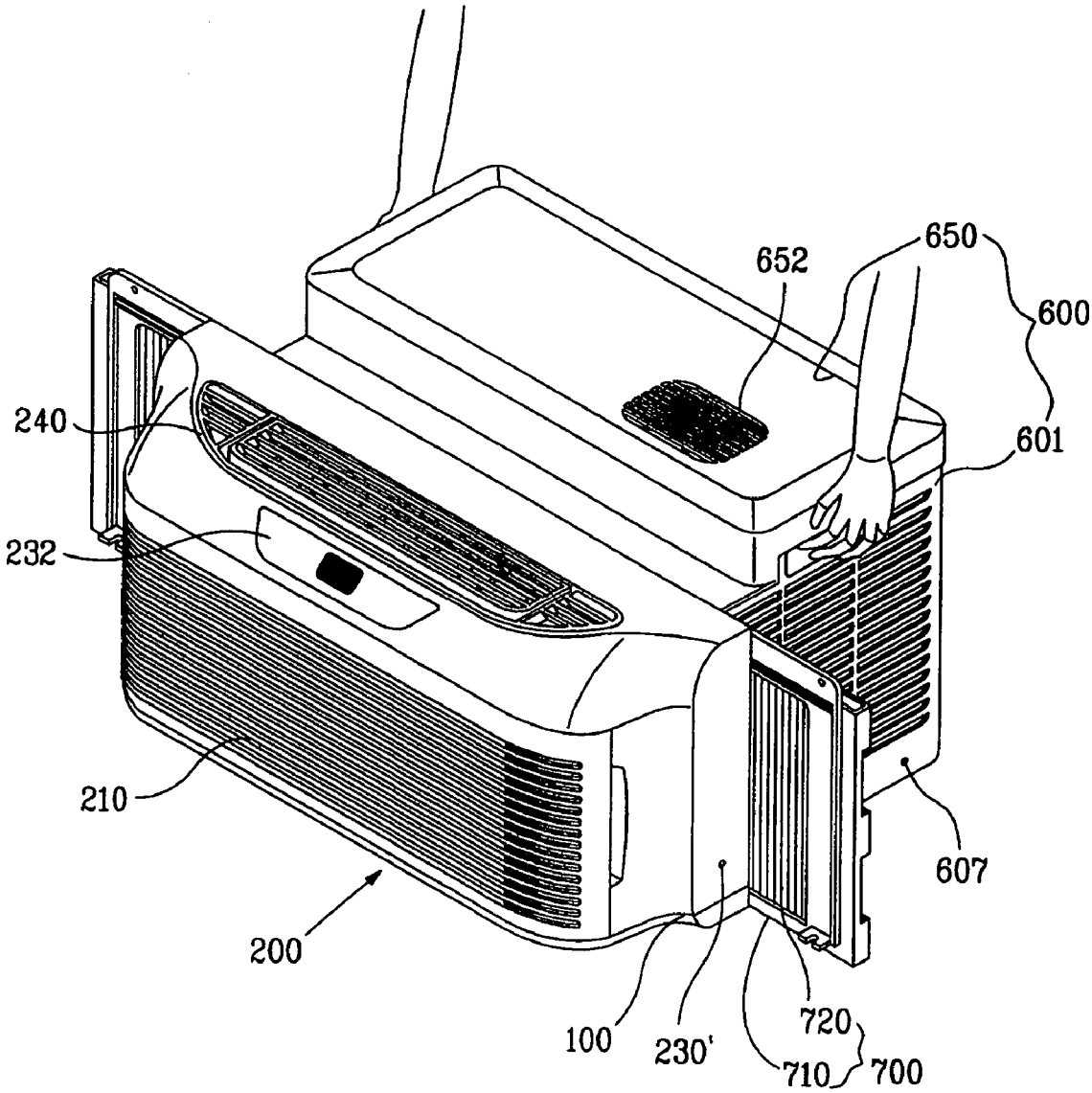
FIG. 13 is a perspective view illustrating the construction of a grip part in an air conditioner according to the present invention.

Referring to FIGS. 12 and 13, an inwardly recessed grip 610 is formed at upper portions of both sides of the cabinet 601 so that a user's hand can be inserted therein. A reinforcing rib 670 is provided at both sides of the outdoor cover 650 positioned in the vicinity of the grip 610 to provide a more strong structure. Here, the reinforcing rib 670 is formed extended downwardly by a predetermined length at both sides of the lower surface of the outdoor cover 650. The reinforcing rib 670 is provided above the position where the grip 610 is formed to reinforce the strength of the outdoor cover 650.

As shown in FIG. 13, an extension 660 downwardly recessed is formed at a front portion of the outdoor cover 650. An insertion channel 682 in which a curtain frame 710 of the curtain assembly 700 is inserted is formed in the extension 660.

In front of the extension 660, a second plate 654 is provided. The second plate 654 is formed extended long in a horizontal direction with a predetermined width at a front portion of the outdoor cover. The second plate 654 is formed in a length corresponding to a width between both front ends of the cabinet 601. The rear end of the front panel is coupled with the second plate 654. For the aforementioned coupling, the second plate 654 has a plurality of insertion holes 655 spaced apart by a predetermined interval from each other.

Figure 14:
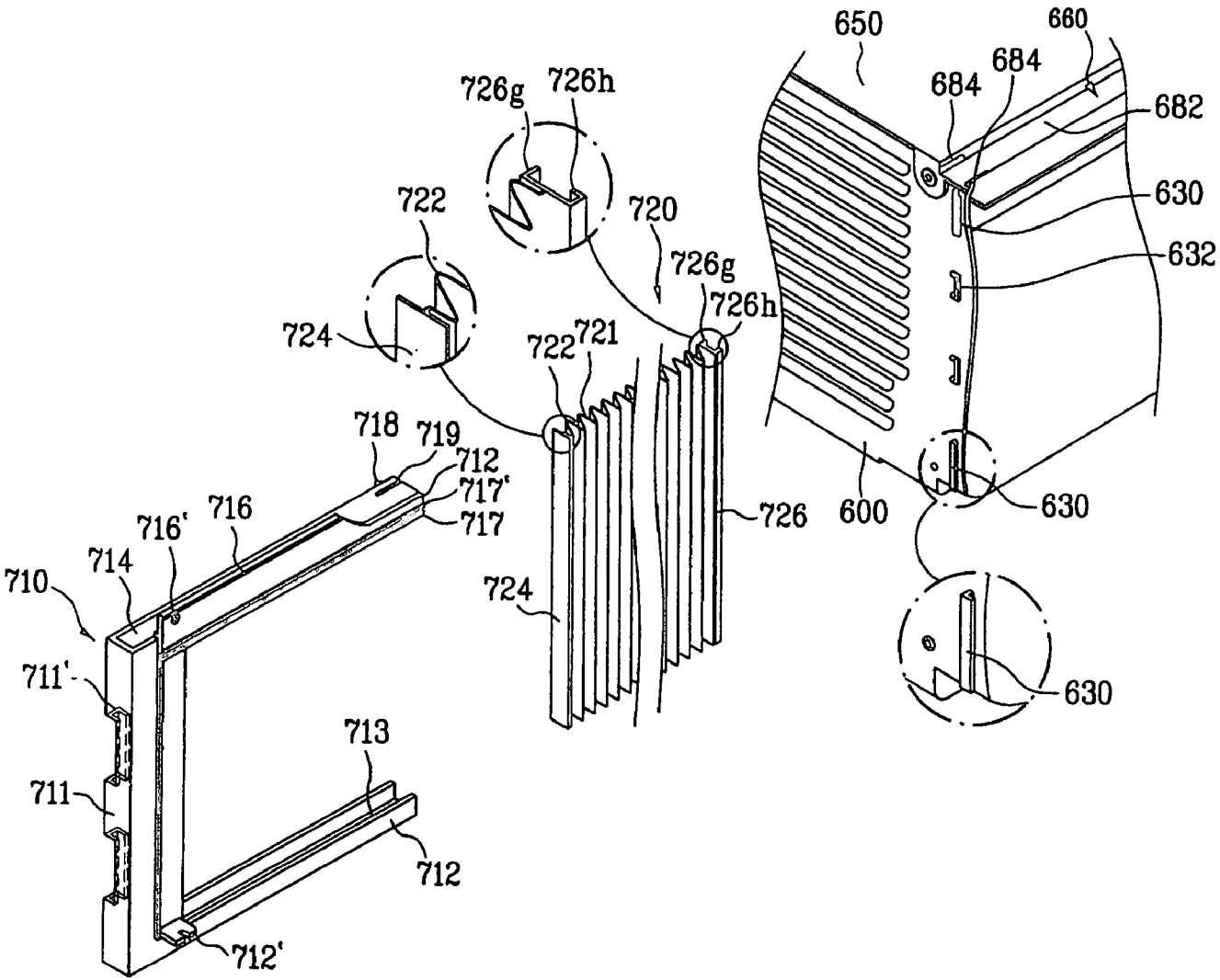
FIG. 14 is a perspective view illustrating a curtain assembly according to the present invention.

Referring to FIGS. 13 and 14, the curtain assembly 700 is provided at both ends of the cabinet 601. A hanger piece 630 and an installation guide piece 632 are formed respectively protruded at both sides of the cabinet 601. The hanger piece 630 is formed in a predetermined length at an upper portion and a lower portion of the side of the cabinet, and has a cross section shaped in letter 'L'. The installation guide piece 632 is provided long in a vertical direction with a predetermined width and is shaped in a channel at a side portion of the cabinet 601.

The curtain assembly 700 is configured to include a curtain frame 710 and a curtain 720 so as to shield a chink between the air conditioner and the window. The curtain frame 710 is provided slidable along an interval between the outdoor cover 650 and the base 110.

Referring to FIG. 14, the outdoor cover 650 is installed on the cabinet 601. The curtain assembly 700 is installed at the extension formed in front of the outdoor cover 650.

The insertion channel 682 is formed long in the horizontal direction along the extension 660, and a horizontal bar 712 of the curtain assembly 700 is inserted in both ends of the insertion channel 662.

Referring to FIG. 7, the guide hole 170 is provided at both lower portions of the base 110. The guide hole 170 is provided to penetrate a lower portion of the barrier 120 along the barrier 120, which partitions the base into the indoor part and the outdoor part. Also, the guide hole 170 is formed integrally with the base and serves as a passage through which the horizontal bar 712 of the curtain assembly 700 is inserted in the guide hole 170.

Accordingly, the horizontal bar 712 of the curtain frame 710 is inserted slidable in the left or right direction along the guide hole 170 and shields the chink between the air conditioner and the window to shield airflow between the exterior and the interior.

As shown in FIG. 14, the curtain frame 710 includes a vertical bar 711 with a predetermined length and the horizontal bar 712 extending perpendicularly with the vertical bar from both ends of the vertical bar 711 and is shaped in a square of which one side is opened. Each of the vertical bar 711 and the horizontal bar 712 has a section shaped in a channel.

Inside the vertical bar 711, there is provided a hanger plate 711' which is extended long. The hanger plate 711' has a width corresponding to half of the width of the vertical bar 711. The hanger plate 711' may be multiple, but the present embodiment exemplarily shows two hanger plates. A guide channel 713 is formed inside the horizontal bar 712. The guide channel 713 guides movement of the curtain 720. A curtain insertion hole 714 is formed in the upper horizontal bar 712. Accordingly, the curtain 720 is inserted into the curtain frame 710 through the curtain insertion hole 714. One end of the curtain 720 is fixed to the hanger plate 711' provided at a lower portion of the curtain insertion hole 714 in the vertical direction.

An installation fence 716 is provided in the horizontal bar 712 formed at the upper end of the vertical bar 711. The installation fence 716 is installed at the upper end of the horizontal bar 712 to be closely in contact with one side of the insertion channel 682. The installation fence 716 is formed in a length that is the almost same as that of the horizontal bar 712.

In the meanwhile, insertion guide pieces 684 formed at an inlet of the insertion channel 682 are formed facing each other. The insertion guide piece 684 has a predetermined gap between the bottom of the insertion channel and the insertion guide piece 684. Also, guide ribs 717, 717' are provided in the horizontal bar 712 and are inserted into the insertion guide pieces 684. The guide ribs 717, 717' are formed long in the length direction of the horizontal bar 712. The gap between the guide ribs 717 and 717' is formed corresponding to the thickness of the insertion guide piece 684.

A release-preventive sill 718 is formed at one end of the horizontal bar 712. The release-preventive sill 718 is shaped in a right-angled triangle when viewed from the top of the curtain frame 710, and is inserted in a state that its slope inclined plate is elastically deformed along the insertion guide piece 684.

An elastic channel 719 is provided at one end of the horizontal bar 712 adjacent to the release-preventive sill 718. The elastic channel 719 allows the curtain frame 710 to be inserted by an elastic deformation when the release-preventive sill 718 is in contact with the insertion guide piece 684.

The curtain 720 is inserted in the curtain frame 710, and is configured to include a plane part 721 with a predetermined width and a connection part 722 connecting the plane parts 721. The plane part 721 is made of relatively rigid material and the connection part 722 is made of flexible material such that the curtain 720 is unfolded or folded freely.

Figure 15:
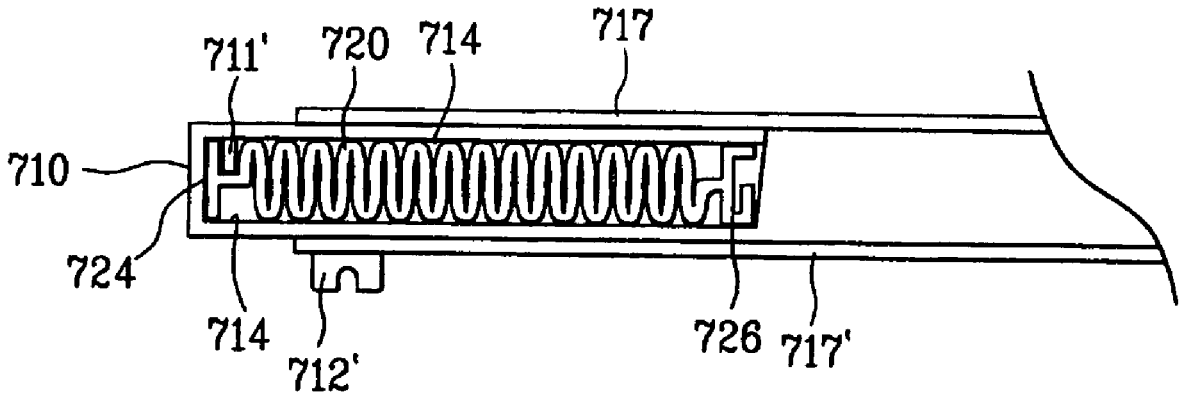
FIG. 15 is a top view of a curtain assembly according to the present invention.

Referring to FIGS. 14 and 15, a first hanger strap 724 hanged on the hanger plate 711' of the vertical bar 711 is provided long at one end of the curtain 720 in the vertical direction. The first hanger strap 724 is hanged on the hanger plate 711' and thereby the curtain 720 is fixed inside the vertical bar 711. The first hanger strap 724 has a section shaped in letter 'T'.

A second hanger strap 726 is provided at the other end of the curtain 720. The second hanger strap 726 is hanged on the hanger pieces 630 and the installation guide piece 632 formed at both sides of the cabinet 601 and thereby is fixed.

The second hanger strap 726 includes a hanger part **726*h* and a guide part 726*g*. The second hanger strap 726 is shaped in a square of which one side is opened. The hanger part 726*h* is inserted into a gap between the hanger plate 630 and the side surface of the cabinet 601 and is fixed. Accordingly, the curtain 720 is folded or unfolded within the curtain frame 710** to effectively shield the chink between the air conditioner and the window.

Hereinafter, operation of an inventive air conditioner having the aforementioned construction will be described.

The inventive air conditioner can operate in cooling mode or heating mode, but the operation in the cooling mode will be described exemplarily. In the cooling mode, the air conditioner discharges indoor heat to an outdoor space.

If the air conditioner operates, indoor air is inhaled into an inside of the air conditioner through the vent grill 210 of the front panel 200 by the indoor fan 410. The air inhaled through the vent grill 210 is purified by the air filter 220 and exchanges heat with the indoor heat exchanger 310. Air cooled while passing through the indoor heat exchanger 310 passes through the indoor fan 410, is guided by the air guides 320, 340 and is again discharged into the indoor space through the discharge grill 244. By repeating the aforementioned heat exchange cycle, indoor space is air-conditioned at a desired state.

Working fluid that has absorbed heat from the indoor heat exchanger 310 is transferred to the outdoor heat exchanger 830 and exchanges heat with air inhaled from the outside to discharge the heat to the outside. In other words, if the outdoor fan 820 rotates, outdoor air is inhaled into the outdoor part through the vent grill part, the cover grill part 660 and the lower grill 150 of the cabinet 601 and flows between the shroud 130, 850 and the barrier 120. The air repeats heat exchange cycle while being discharged to the outdoor heat exchanger 830 by the blower fan 820.

Next, there will be described a method to install an inventive air conditioner at a window with reference to FIG. 16.

The curtain 720 is inserted into the curtain frame 710 through the curtain insertion hole 714. The curtain 720 is inserted in such a state that the adjacent plane parts 721 are folded to be closely in contact with each other. Here, the first hanger strap 724 formed at one end of the curtain 720 is hanged on the hanger plate 711' formed in the vertical bar 711 and thereby is fixed.

The lower one of the horizontal bars 712 of the curtain frame 710 in which the curtain 720 is inserted is inserted into the guide hole 170 provided at the lower portion of the base 110, and the upper one is inserted into the insertion channel 682 formed in the extension 660 of the outdoor cover 650.

When the curtain frame 710 is inserted into the insertion channel 682, the release-preventive sill 718 contacts the insertion guide piece 624. As the insertion of the curtain frame 710 progresses, the release-preventive sill 718 is pushed and thereby the elastic channel 719 is pressed. Once the release-preventive sill 718 passes the insertion guide piece 684, it is restored and restrained by the insertion guide piece 684 so that the curtain frame is not released.

The horizontal bar 712 slides along the guide hole 170 and the insertion channel 682 of the extension 660 and thereby the protruded length of the curtain frame 710 toward an outward direction of the cabinet 601 is adjusted.

Figure 16:
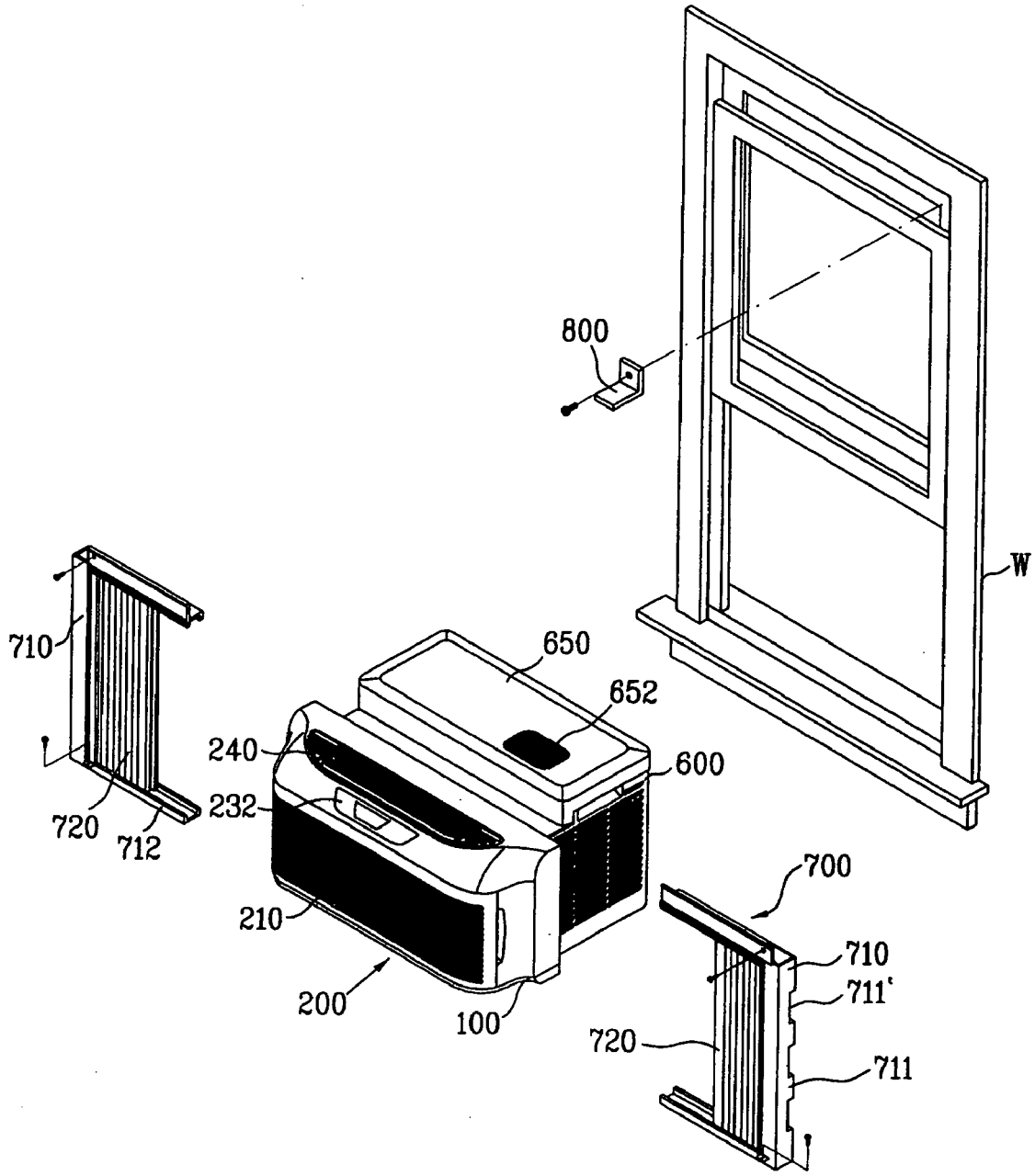
FIG. 16 is a perspective view illustrating to install a curtain assembly of the present invention on a window.

As shown in FIG. 16, when the air conditioner is installed at the window (W), the curtain 720 shields the gap between the window (W) and the side surface of the air conditioner. In other words, the vertical bar 711 is closely in contact with one side of the window (W) by moving the curtain frame 710 installed in the air conditioner along the guide hole 170 and the insertion channel 682, so that the gap between the window (W) and the air conditioner is shielded. After the air conditioner is installed at the window (W), the air conditioner is fixed by a fixing bracket 800 such that the window is not moved.

As described previously, since an outer case of an air conditioner according to the present invention is comprised of a cabinet forming both side faces and rear face and an outdoor cover forming upper face separately, it is possible to separate only the front panel and the outdoor cover for repair and maintenance of inner parts, thereby providing users with convenience.

Also, since the cabinet can be assembled with the base by simply pushing the base in an upper surface of the insertion guide formed along a lower edge of the cabinet, convenience in assembling is provided. In addition, since a loading recess on which the hanger plate for the coupling of the cabinet and the outdoor cover is loaded, and an insertion slot into which the installation protrusion is inserted are respectively provided, the cabinet and the outdoor cover can be assembly more easily.

Further, since a grip is formed in the cabinet, the air conditioner can be handled more easily. Since a reinforcing rib for reinforcing strength is provided at one side of the outdoor cover adjacent to the grip, reliability and strength of the air conditioner products are enhanced.

In the present invention, since passages through which outdoor air is inhaled are formed even at both sides of the cabinet, the outdoor cover and the base, the amount of inhalant air is increased to increase heat exchange amount of the air conditioner.

In the meanwhile, the curtain frame of the curtain assembly in an inventive air conditioner is inserted respectively into the guide hole formed penetrating a lower portion of the base and the insertion channel formed integrally with the cabinet in a recessed structure and slides. Accordingly, since the curtain assembly parts are not shown from the interior, the appearance of the air conditioner is enhanced. Also, since the curtain assembly parts are not protruded outwardly, air leakage can be simply prevented.

Furthermore, since the guide hole and the insertion channel installed at the curtain assembly are formed integrally with the base and the cabinet, a separate part is not required so that assembling process of the air conditioner is simplified. Moreover, the release-preventive sill formed in an end of the curtain frame can be simply assembled by elastic deformation on the insertion channel such that it is not released.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An air conditioner comprising:

an indoor part configured to intake indoor air to exchange heat with an indoor heat exchanger, and again discharging the heat-exchanged air into an indoor space;

an outdoor part configured to intake an outdoor air to exchange heat with an outdoor heat exchanger, and again discharging the heat-exchanged air into an outdoor space;

a base partitioned into the outdoor part and the indoor part and loaded on the partitioned outdoor part and indoor part;

a cabinet provided to cover both sides and a rear surface of the outdoor part, and having an insertion guide formed at a lower portion thereof; and an outdoor cover provided on an upper portion of the cabinet so as to cover the upper portion of the outdoor part, wherein said outdoor cover is detachable from the cabinet.

2. The air conditioner of claim 1, wherein the outdoor cover is provided attachable on the cabinet.

3. The air conditioner of claim 1, wherein the outdoor cover comprises a cover grill formed at a predetermined portion of the upper face thereof and through which outdoor air is intaken.

4. An air conditioner comprising:

an indoor part configured to intake indoor air to exchange heat with an indoor heat exchanger, and again discharging the heat-exchanged air into an indoor space;

an outdoor part configured to intake an outdoor air to exchange heat with an outdoor heat exchanger, and again discharging the heat-exchanged air into an outdoor space;

a cabinet provided to cover both sides and a rear surface of the outdoor part, and having an extension downwardly recessed with a predetermined width at a front side thereof;

a base having a guide hole formed at a lower portion thereof to correspond to a position where the extension is formed, the base being partitioned into the outdoor part and the indoor part and loaded on the partitioned outdoor part and indoor part; and a curtain assembly respectively provided at both sides of the extension and the guide hole to be slidable along the extension and the guide hole.

5. The air conditioner of claim 4, wherein the curtain assembly comprises:

a curtain provided for shielding a chink between a side surface of the air conditioner and a window; and a curtain frame supporting the curtain and inserted into the extension and the guide hole.

6. The air conditioner of claim 5, wherein the curtain frame comprises:

an upper horizontal bar inserted into the extension; a lower horizontal bar inserted into the guide hole; and a vertical bar connecting the upper horizontal bar and the lower horizontal bar with each other.

7. The air conditioner of claim 6, wherein a hanger plate is provided protruded inside the vertical bar and a first hanger strap formed at one side of the curtain is inserted into the hanger plate and is fixed.

* * * * *